United States Patent [19]

Cushing

[11] 4,422,643

[45] Dec. 27, 1983

[54] GOLF SWING TRAINING DEVICE

[76] Inventor: Emmet J. Cushing, 6115 Dupont Ave. South, Minneapolis, Minn. 55419

[21] Appl. No.: 374,435

[22] Filed: May 3, 1982

[51] Int. Cl.[3] ..... A63B 69/36

[52] U.S. Cl. ..... 273/183 B; 273/191 R

[58] Field of Search ..... 273/188 R, 189 R, 191 B, 273/191 R, 191 A, 183 B, 192; 434/252

[56] References Cited

U.S. PATENT DOCUMENTS

| | | | |
|---|---|---|---|
| 1,530,519 | 3/1925 | Remington | 273/188 R |
| 1,699,219 | 1/1929 | Bemish et al. | 273/189 R |
| 2,690,911 | 10/1954 | Newgren | 273/188 R |
| 2,773,691 | 12/1956 | Redfield | 273/189 R |
| 3,415,524 | 12/1968 | Vickers | 273/189 R |
| 3,595,583 | 1/1971 | Oppenheimer | 273/191 B |

*Primary Examiner*—George J. Marlo

*Attorney, Agent, or Firm*—Jacobson & Johnson

[57] ABSTRACT

A device for guiding the swing of a golfer from the address position to the apex of the back swing and through the forward swing until contact with the ball, constructed in a harness-like fashion made of rigid material carried on the shoulder of the user and having a rigid guide bar in front of the golfer located and angled so that the golfer's arm brushes against the guide bar through the back stroke and forward stroke without interfering with the swing.

7 Claims, 5 Drawing Figures

GOLF SWING TRAINING DEVICE

FIELD OF THE INVENTION

The invention is a device for aiding a golfer to develop a correct swing. It not only provides a guide whereby the golfer, by repetitive use, can develop the correct swing but also provides means whereby the golfer can check the correct position for his arms, hands and body at various points in the golf swing from the address position through the back swing and through the forward swing up to impact with the ball.

DESCRIPTION OF THE PRIOR ART

Over the years a large number of devices for use as training guides for developing a proper golf swing have been designed. A number of these are quite complex and cumbersome mechanisms which might be useable in an indoor or outdoor practice area but are not portable to permit the golfer to use them throughout a practice round of golf. Other training devices have not provided for a positive arm guide which would guarantee proper arm/body coordination through the turning positions. Typical of these types of mechanisms are U.S. Letters Pat. No. 1,530,519 dated Mar. 24, 1925; 2,690,911 dated Oct. 5, 1954 and 3,415,524 dated Dec. 10, 1968. Other less complex and more portable devices are illustrated in U.S. Letters Pat. Nos. 1,699,219 dated Jan. 15, 1929; 2,773,691 dated Dec. 11, 1956 and 3,595,583 dated July 27, 1971. All of the above-identified devices are designed to direct, control or guide the movement of the golfer's arms, the club head, the stabilization of the head, the body movement and/or various combinations thereof. Their designs are based upon various theories as to what constitutes the correct golf swing, correct body and head positioning and correct body movement. Typical is the theory stated in the aforementioned '911 patent in col. 1 starting about line 10 where it states:

"Some of the essentials of a proper golf swing are the stiffening of the left side of the body with a straight left arm during the down swing, maintaining the head downwardly with the eyes directly on the ball during the down swing, a direct stance by maintaining the feet the correct distance apart—follow through of the club after the impact, the coordination of different parts of the body such as the hips, legs, arms, hands and wrists during the swing", etc.

SUMMARY OF THE INVENTION

Some preliminary considerations might be useful in fully understanding the instant invention. The following explanation and description will relate to a right-handed golfer but it should be understood that the same principles and the same features apply mutatis mutandi for left-handed golfers.

The actual arm swing necessary for executing a good golf swing is for the arms to move from initial position addressing the ball to the top of the back swing in front of the right shoulder in a relatively straight line. This is demonstrated by having the golfer stand erect gripping a golf club in his normal fashion as if addressing the ball, then breaking the wrists to bring the club straight upward so that the shaft of the club is perpendicular to the ground, then raising his hands, still holding the club, to eye level and next, without moving the rib cage and while facing straight ahead, moving the hands toward the right as far as they will comfortably go. Under these conditions the hands cannot move very far rightward. I have found that in the proper golf swing bringing the hands with the club up from the address position to this rightward elevated position, as described above, in combination with the turn of the body constitutes the proper back swing and combined with weight shift and/or hip movement results in a proper forward swing to impact. The concept then is to guide the movement of the hands in the back swing with respect to the rib cage and my invention conveniently and effectively does this by guiding movement of the arms with respect to the breastbone in a manner as described hereinbelow.

In summary, the training device of this invention constitutes an elongated, rigid, guide rod located in front of the golfer's body and angled to guide the hands and arms upward and rightward to the proper location during the back swing. This guide rod is attached to a support which has one section arched over the shoulders of the golfer and resting substantially stable on or at the back of the golfer and another section continuing from the first section downward along the front of the body to substantially stable resting location at the breastbone with the guide rod attached to the second section. To add further stability, a strap may be provided to removably attach together the two sections of the support.

The two support sections and the guide rod are preferably adjustably joined together to accommodate variations in the physical structure of various golfers. Preferably, the support and the guide rod are made of rigid yet lightweight material so that the device is easily portable and can be worn by the golfer or easily slipped on and off as the golfer plays a practice round of golf using the training device.

DESCRIPTION OF THE PREFERRED EMBODIMENT

Figure 1:
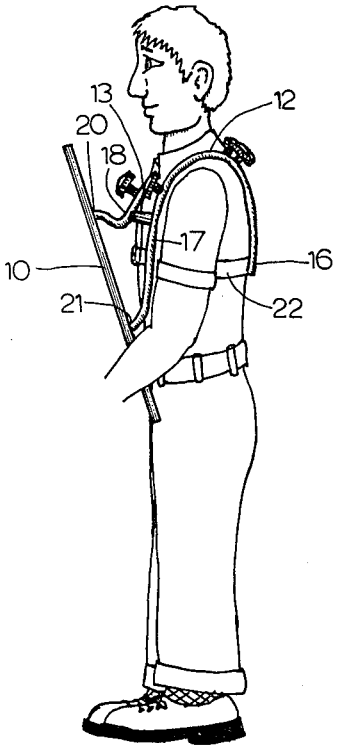
FIG. 1 is a left side view showing a preferred embodiment of the invention mounted on a golfer standing erect.

The device can be considered to be made up of two main portions, one the guide bar 10 and the other the mounting or support generally referred to by reference numeral 11. The mounting 11 can be best described as made up of two sections, one section 12 extending over the shoulder and at least part way down the back of the user and the other section 13 extending downward from the shoulder in front of the body of the user. The entire device is constructed out of lightweight rigid material. For example, copper tubing ranging from about ¼" to ½" diameter or suitable plastic rod material or anything similar having the desired rigidity and lightweight characteristics can be utilized. Section 12 of mount 11 comprises a pair of members 14 and 15 which are curved to arch over the shoulders of the user on each side of the neck and extend at least part way down the back and are joined together and rest against the back at point 16.

The precise location of resting point 16 is a matter of choice but it should be somewhere below the shoulder. Alternatively, each of the members 14 and 15 can be separately run part way down the back to a stable location against the back although it is preferred that they be joined together for greater stability.

Figure 2:
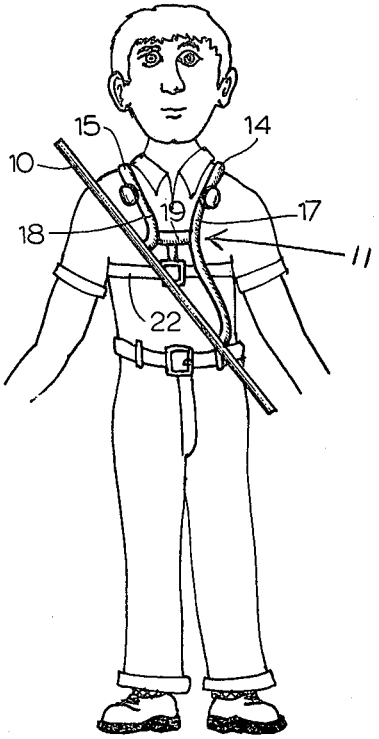
FIG. 2 is a front view.
Figure 3:
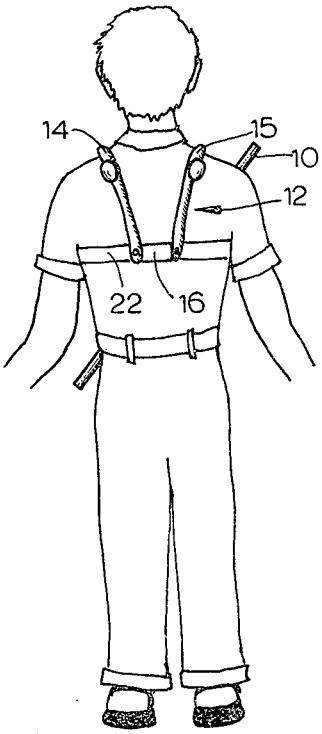
FIG. 3 is a back view.
Figure 4:
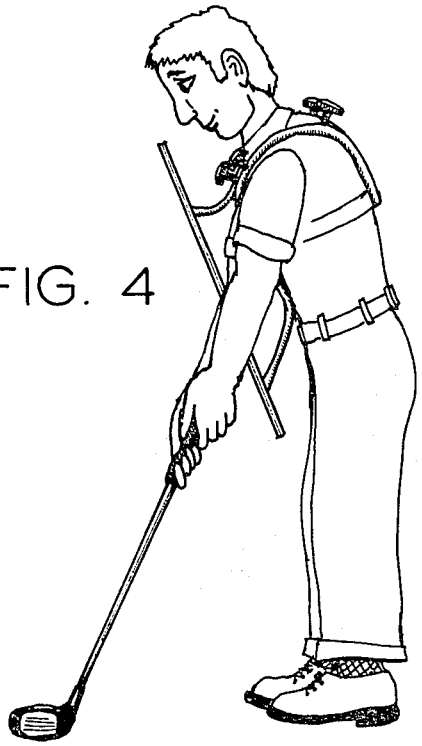
FIG. 4 is a left side view of a preferred embodiment of the invention mounted on a golfer in the address position.
Figure 5:
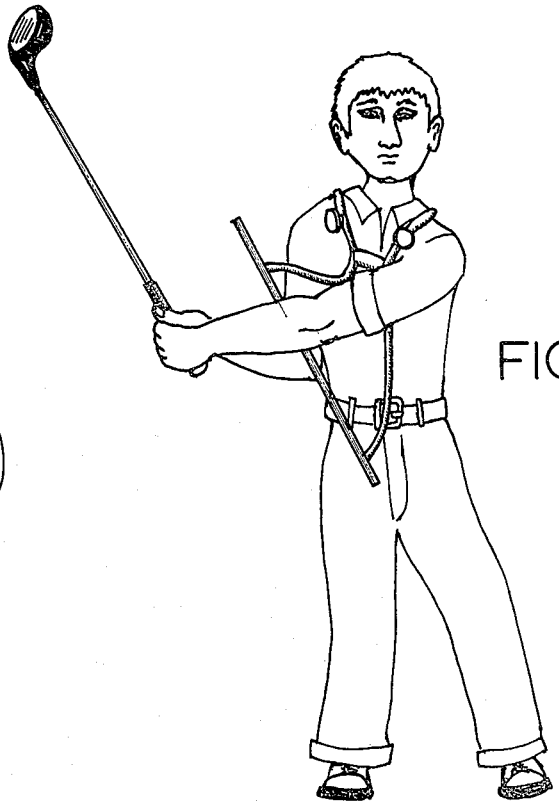
FIG. 5 is a front view showing a preferred embodiment of the invention mounted on a golfer showing the golfer in the forward swing part way between the top of the back swing and the address or impact position.

Extending downward in front of the user from members 14 and 15 are members 17 and 18 which are connected together at 19 which rests at about the breastbone on the chest of the wearer. A suitable pad, not shown, may be provided at junction 19 to prevent discomfort of pressure against the breastbone. From the junction at 19 member 18 continues curved rightward and upward to attach to guide rod 10 at point 20 and member 17 continues curved leftward and downward to attachment to the guide rod 10 at point 21 as best illustrated in FIGS. 1 and 2. The attachment points are near opposite ends of the guide rod 10. The guide rod 10 is angled upward and rightward to correspond to the direction that the golfer's hands and arms should move as he brings the golf club back from the address position to the apex of his back swing and then forward to impact the ball. The bottom or lower location for guide rod 10 is determined by the location of the golfer's arm when initially addressing the ball, such as illustrated in FIG. 4. The upper location of the guide rod 10 is determined by the path the arms and hands should follow up to the apex of the back swing. In essence, then, the golfer is guided and shown to raise the golf club from the address position and move it slightly rightward with respect to the rib cage from the stable location of the training device at the breastbone. At the same time the golfer would normally be turning the body and the shoulders so that the club head then follows the correct trajectory on the back swing. Then following the same guide line with the coordinated movement of the body and shoulders and legs the correct trajectory in the forward swing to make the best contact with the ball is achieved. The length of guide rod 10 should be sufficient so that the golfer's left arm when gripping the golf club brushes against the guide rod 10 at the address position and brushes against it at the height of the back swing.

In order to insure stability of the device during the swing, a strap 22 is provided to attach the rear section 12 to the front section 13 of the support 11, preferably from point 16 to point 19. Preferably this strap is made from stretchable type material and has a releasable buckle.

Typically, in the use of the instant invention the golfer's swing is guided and at the same time he learns the correct location for his arms and hands during the course of the swing. The following is a list of the various items of this nature derived from the use of this invention:

1. The golfer learns to position his hands the same distance from his body each time he addresses the ball.

2. He learns that he merely has to lift the arms and the hands upward in a line along the line of the guide rod.

3. With the hands carrying the club at about hip high in the back swing with the left arm and club pointing to the rear and parallel with the target line, and with the left arm brushing the guide bar it shows how much the body must be turned to improve and coordinate the back swing pivot.

4. At the top of the back swing with the shoulders turned approximately 90° from the address position, the club is then in the right position to start the forward swing with the club pointing over the right shoulder toward the target at the top of the back swing and the hands in line with and just above the right shoulder when sighting from the rear of the golfer.

5. On the down swing when the hands have reached approximately hip level with the arms parallel with the target line the guide bar will point directly along the target line only when the correct weight shift is performed by the lower part of the body.

6. Also, in the forward swing with the left arm straight back on the target line at hip level the golfer sees that the right shoulder will still be turned considerably to the right away from the target line as is necessary in a proper swing.

While the embodiment illustrated in the drawing shows that the guide rod 10 is connected to the support 11 at two points by the continuation of members 17 and 18, the connection can be made by a single member extending from 19 where members 17 and 18 are joined together to the guide bar 10. A two-point attachment for the guide bar insures stability of the guide bar during the swing.

Preferably, while not shown in detail, sections 13 and 12 are adjustably joined together. This can be done conveniently by having the respective members 17 and 14 and 18 and 15 telescopically joined with a set screw or clamp holding them fixed in their desired relative positions after they have been adjusted correctly. Similarly, the connection between the front section 13 of support 11 to the guide bar 10 is preferably adjustable. This can be done similarly by having the extensions of members 17 and 18 in two telescopically joined parts with set screws or clamps for locking the parts together when correctly positioned. In the instance where a single member holds the guide rod 10 between the guide rod and support 19, a universal connection can be made, such as a ball and socket arrangement, which will permit the guide bar to be tilted and rotated right and left, up or down as desired. The single member preferably should incorporate a telescopic feature to change its length to adjust the distance between the body and the guide bar 10. A pivot point or swivel may also be provided which allows the single support rod to swing sideward across the chest to make room for arm swing in the follow through. The connections can then be locked by a clamp or set screw of the like to be held firmly in position for use when the desired angular positions are set. The adjustable attachments provide the adjustments necessary to accommodate the device to the physical variations among different golfers.

As can be observed, because of the light weight of the device and its relative simplicity, it can be carried on the shoulders of the user who can then take his golf swing and leave it on his shoulders as he does down the fairway to the next shot or he can easily remove it and place it again on the shoulders for the next shot further down the fairway.

It should be pointed out that to enable the golfer to make a full forward swing the guide bar 10 should be provided with a releasable attachment at the upper end with a swivel type attachment at the lower end so as the right hand and arm come forward after impact, the follow through is not impeded. When guide bar 10 is supported by a single member extending frome support 19, as described above, the swivel may be part of that single member.

I claim:

1. A golf swing training device comprising:

(a) a first section made of rigid material arched over the user's shoulder on each side of the neck and extending to rest against the user's back in substantially stable fashion below the shoulder level;

(b) another section of rigid material continuing from the first section downward from the shoulder along the front of the user resting in substantially stable fashion at about the user's breastbone; and (c) a straight rigid elongated member attached to and spaced forward from said another section angled in an upward direction, in a forward direction and in a side direction.

2. The training device as described in claim 1 further including a strap for detachably tieing said first section at the back of the user to said another section at the front of the user.

3. The training device as described in claim 2 wherein said first section comprises two separate rigid members arched over the user's shoulder; and said another section comprises two separate rigid members, each continuing from one of the first section members and joined together at about the location of the user's breastbone.

4. The training device as described in claim 1 wherein the elongated member is located forward from said another section and angled to direct the arm of the user holding the golf club to follow a correct path during the back and forward swing of said arm by brushing against the elongated member thereby providing a means for arm and body coordination during the swing.

5. The training device as described in claim 4 wherein the elongated member is of a length to brush the user's arm from the ball address position to the apex of the back swing and through the forward swing until the club head impacts the ball.

6. The training device as described in claim 4 wherein the sections and the elongated member are made of substantially lightweight material.

7. The training device as described in claim 4 wherein the first section and said elongated member are adjustably attached to said another section.

* * * * *